US011359778B1

(12) United States Patent
Kim

(10) Patent No.: US 11,359,778 B1
(45) Date of Patent: Jun. 14, 2022

(54) LED DOWNLIGHT DEVICE

(71) Applicants: SEOHYUN INTERNATIONAL CORP., Nonsan-si (KR); Doo Joon Kim, Seoul (KR)

(72) Inventor: Doo Joon Kim, Seoul (KR)

(73) Assignees: SEOHYUN INTERNATIONAL CORP., Nonsan-si (KR); Doo Joon Kim, Seoul (KR)

( * ) Notice: Subject to any disclaimer, the term of this patent is extended or adjusted under 35 U.S.C. 154(b) by 0 days.

(21) Appl. No.: 17/124,414

(22) Filed: Dec. 16, 2020

(30) Foreign Application Priority Data

Nov. 27, 2020 (KR) ..... KR10-2020-0162993

(51) Int. Cl.

| | |
|---|---|
| ***F21S 8/02*** | (2006.01) |
| ***F21V 29/77*** | (2015.01) |
| ***F21V 7/04*** | (2006.01) |
| ***F21V 3/00*** | (2015.01) |
| ***F21V 23/00*** | (2015.01) |
| ***F21V 23/06*** | (2006.01) |
| ***F21V 17/00*** | (2006.01) |
| ***F21Y 115/10*** | (2016.01) |

(52) U.S. Cl.
CPC ..... *F21S 8/026* (2013.01); *F21V 3/00* (2013.01); *F21V 7/04* (2013.01); *F21V 17/002* (2013.01); *F21V 23/002* (2013.01); *F21V 23/008* (2013.01); *F21V 23/06* (2013.01); *F21V 29/773* (2015.01); *F21Y 2115/10* (2016.08)

(58) Field of Classification Search
CPC ..... F21S 8/026; F21V 29/773; F21V 3/00; F21V 7/04; F21V 17/002; F21V 23/008; F21V 23/06; F21Y 2115/10
See application file for complete search history.

(56) References Cited

U.S. PATENT DOCUMENTS

| | | | | |
|---|---|---|---|---|
| 8,523,406 | B2 * | 9/2013 | Kwong | F21K 9/20 362/311.02 |
| 8,882,308 | B2 | 11/2014 | Cho | |
| 2014/0307450 | A1 * | 10/2014 | Cho | F21S 8/02 362/364 |
| 2016/0312987 | A1 * | 10/2016 | Danesh | F21S 8/024 |
| 2020/0363025 | A1 * | 11/2020 | Jeswani | H05B 45/54 |

FOREIGN PATENT DOCUMENTS

KR 10-2015-0116628 A 10/2015

* cited by examiner

*Primary Examiner* — Andrew J Coughlin
*Assistant Examiner* — Jessica M Apenteng
(74) *Attorney, Agent, or Firm* — ArentFox Schiff LLP

(57) ABSTRACT

Provided is an LED downlight device including: a downlight body having an LED module having multiple LEDs, a heat sink receiving the LED module therein and dissipating heat generated from the LEDs, a reflector coupled to an inner side of a lower surface of the heat sink and reflecting light from an LED light source, a diffuser cover detachably coupled to the reflector and diffusing light from the LED light source, and a housing coupled to an outer side of the lower surface of the heat sink and protecting the reflector and the diffuser cover; an LED driver performing switching from AC to DC and supplying an appropriate voltage to the LED module; a first connector unit connecting a first electric wire with a second electric wire; and a second connector unit integrated with the LED driver, and connecting the second electric wire with a third electric wire.

7 Claims, 5 Drawing Sheets

LED DOWNLIGHT DEVICE

CROSS REFERENCE TO RELATED APPLICATION

The present application claims priority to Korean Patent Application No. 10-2020-0162993, filed Nov. 27, 2020, the entire contents of which is incorporated herein for all purposes by this reference.

BACKGROUND OF THE INVENTION

Field of the Invention

The present disclosure relates to an LED downlight device that is installed and recessed in an indoor ceiling. More particularly, the present disclosure relates to an LED downlight device that reduces the weight of an LED downlight to improve ease of installation, and that reduces maintenance cost and ensures flexibility in management.

Description of the Related Art

In general, a downlight is a light fixture that is installed into a hollow opening in a ceiling. There is little exposure of the light fixture and the ceiling looks well ordered. Therefore, generally, downlights are mainly used in indoor ceilings, such as in houses, offices, government offices, schools, shopping centers, etc. or in narrow spaces of buildings, corridors, washrooms, toilets, etc.

Conventionally, a downlight using a halogen lamp as a light source is mainly used, but this produces excessive heat and consumes too much power. Recently, a downlight using an LED with low power consumption as a light source has been widely used.

As shown in FIG. 1, it is disclosed in U.S. Pat. No. 8,882,308 an LED downlighting apparatus including: an LED module 10 having multiple LEDs provided at a circuit board; a heat sink 20 receiving the LED module 10 therein and supporting the same, and dissipating heat generated from the LEDs; an LED driver 30 provided on the heat sink 20 and supplying power to the LED module 10; inner and outer reflectors 40 and 50 coupled to a lower surface of the heat sink 20 and reflecting light from the LED light source; and a connector cover 70 having a built-in connector 71 that connects a first electric wire element 31 coming from the LED driver 30 of a downlight with a second electric wire element 61 coming from a junction box 60.

Herein, the LED driver 30 uses a constant-current driving method in which switching from alternating current (AC) supplied from outside into direct current (DC) takes place and conversion into appropriate voltage takes place for supply. The LED driver 30 is fixed on the top of the heat sink 20.

However, the LED driver has the concept of a set where the LED driver is fixed on the top of the heat sink and forms one body with the downlight. Therefore, the downlighting apparatus is heavy, which causes difficulty in installing the downlight.

In addition, the power required for the LED downlight may vary depending on a place of use. Since the LED driver is fixed at the downlight, the entire downlight needs to be replaced depending on the power of the LED driver.

In addition, even when the LED driver fails or runs out, it is necessary to replace the entire LED downlight.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, the present disclosure has been made keeping in mind the above problems occurring in the related art.

The present disclosure is directed to providing an LED downlight device, wherein an LED driver is separated from a downlight and a first connector unit connects a first electric wire connected to an LED module of the downlight with a second electric wire connected to the LED driver to reduce the weight of the downlight, so that ease of installing the downlight is improved, and wherein when the downlight or the LED driver fails or runs out, individual replacement is able to be achieved, and only the LED driver is able to be replaced depending on the required power, so that the maintenance cost is reduced and flexibility in management is ensured.

In addition, the present disclosure is directed to providing an LED downlight device, wherein a second connector unit connects a second electric wire connected to an LED driver with a third electric wire coming from a junction box and the second connector unit and the LED driver are integrated, so that convenience of installing and replacing the LED driver is improved.

According to an embodiment of the present disclosure, there is provided an LED downlight device including: a downlight body having an LED module having multiple LEDs provided at a circuit board, a heat sink receiving the LED module therein and supporting the same and dissipating heat generated from the LEDs, a reflector coupled to an inner side of a lower surface of the heat sink and reflecting light from an LED light source, a diffuser cover detachably coupled to the reflector and diffusing light from the LED light source, and a housing coupled to an outer side of the lower surface of the heat sink and protecting the reflector and the diffuser cover; an LED driver performing switching from alternating current (AC) supplied by a junction box to direct current (DC) and supplying an appropriate voltage to the LED module; a first connector unit connecting a first electric wire connected to the LED module of the downlight body and coming from a side of the heat sink with a second electric wire connected to a side of the LED driver; and a second connector unit integrated with the LED driver, and connecting the second electric wire connected to the LED driver with a third electric wire coming from the junction box.

Each of the first, the second, and the third electric wire may be wrapped in a spiral metal conduit covering an outer side of each of the electric wires for protection.

The first connector unit may include a connector connecting the first electric wire with the second electric wire, and a connector cover covering an outer side of the connector for protection, and the connector cover may include an upper cover and a lower cover that are detachably coupled to each other.

Herein, the lower cover may include a bottom surface having an end at which a front wall stands vertically, a first electric wire insertion hole into which the first electric wire is inserted may be formed in the front wall, a hook may be formed at another end of the bottom surface opposite to the front wall, and a first fastening hole may be formed at a position adjacent to the first electric wire insertion hole, in left and right side walls connecting an upper end of the front wall with the end of the bottom surface at which the hook is formed. The upper cover may include a top surface having an end at which a rear wall stands vertically, a second electric wire insertion hole into which the second electric wire is inserted may be formed in the rear wall, a slot into which the hook of the lower cover is engaged may be formed below the second electric wire insertion hole, and a second fastening hole may be formed at a position corresponding to the first fastening hole, in left and right side walls connecting a lower end of the rear wall with another end of the top surface. The hook of the lower cover may be engaged into the slot of the upper cover so that an end of the lower cover and an end of the upper cover are fixed, and another end of the upper cover and another end of the lower cover may be pressed against each other so that the first fastening hole of the lower cover and the second fastening hole of the upper cover are aligned, and a fastening bolt may be fastened into the first fastening hole and the second fastening hole.

In addition, a clip fixing the spiral metal conduit may be coupled into each of the first and the second electric wire insertion hole, the clip may be partially cut in a longitudinal direction of its hollow body into which the spiral metal conduit is inserted, a protruding piece engaged in a spiral groove of the metal conduit may be formed at the cut surface, and a wing piece caught inside the electric wire insertion hole and a flange caught outside the electric wire insertion hole may be provided at an outer side of the body.

In addition, the second connector unit may include a connector connecting the second electric wire with the third electric wire, and a connector cover covering an outer side of the connector for protection. A size of the LED driver may vary depending on a value of a watt (W), and depending on the size, the LED driver may be provided inside the connector cover or provided outside the connector cover, being integrated with the connector cover.

In addition, the LED downlight device may further include a frame for fixing that is provided outside the LED driver or the second connector unit.

According to the embodiment of the present disclosure, the LED driver is separated from the downlight, so that the weight of the downlight is reduced. In addition, the first connector unit detachably connects the first electric wire connected to the LED module of the downlight with the second electric wire connected to the LED driver, thereby improving ease and convenience of installing the downlight.

In addition, when the downlight or the LED driver fails or runs out, individual replacement can be achieved, and only the LED driver needs to be replaced depending on the required power, so that maintenance cost can be reduced and flexibility in management can be ensured.

In addition, the second connector unit and the LED driver are integrated, so that convenience of installing and replacing the LED driver can be improved.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
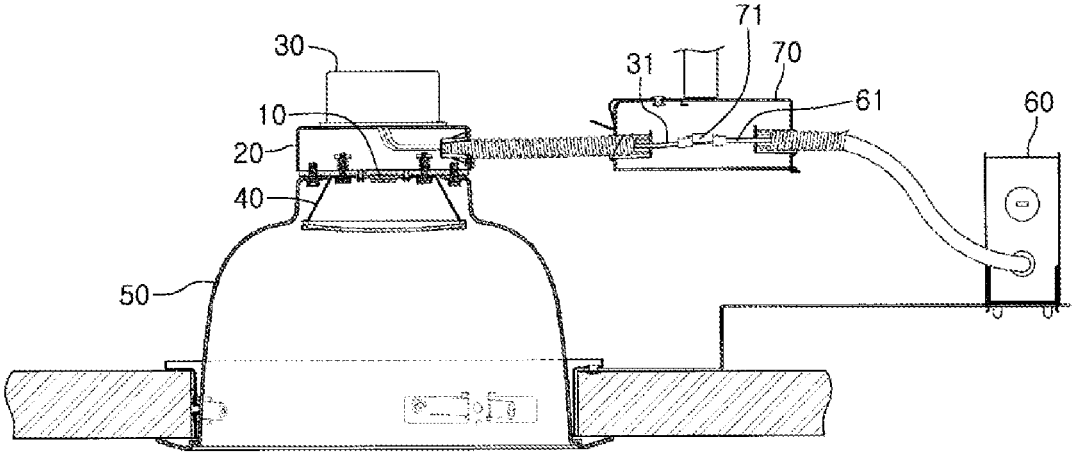
FIG. 1 is a cross-sectional view showing a conventional LED downlight device.

A detailed description of the present disclosure described below relates to embodiments of the present disclosure, and the accompanying drawings shown as examples of the embodiments will be referenced. The embodiments will be described in sufficient detail to enable those skilled in the art to implement the present disclosure. It is to be understood that the various embodiments of the present disclosure, although different, are not necessarily mutually exclusive. For example, a particular shape, structure, and characteristic described herein in connection with one embodiment may be implemented in other embodiments without departing from the spirit and the scope of the present disclosure. In addition, it is to be understood that the location or arrangement of individual elements within each disclosed embodiment may be modified without departing from the idea and the scope of the present disclosure.

Therefore, the following detailed description is not to be taken in a limiting sense, and if appropriately described, the scope of the present disclosure is defined only by the appended claims and all scopes equivalent to the claims. In the drawings, like reference numerals refer to the same or similar functions throughout several aspects.

All terms including descriptive or technical terms which are used herein should be construed as having meanings that are obvious to one of ordinary skill in the art. However, the terms may have different meanings according to an intention of one of ordinary skill in the art, precedent cases, or the appearance of new technologies. In addition, some terms may be arbitrarily selected by the applicant, and in this case, the meaning of the selected terms will be described in detail in the description of the disclosure. Thus, the terms used herein have to be defined based on the meaning of the terms together with the description throughout the specification.

Throughout the specification, when a part "includes" an element, it is noted that it further includes other elements, but does not exclude other elements, unless specifically stated otherwise. In addition, the terms "~ part", "~ module", and the like mean a unit for processing at least one function or operation and may be implemented by a combination of hardware and/or software.

A certain embodiment of the present invention provides an LED downlight device including: a downlight body having an LED module having multiple LEDs provided at a circuit board, a heat sink receiving the LED module therein and supporting the same and dissipating heat generated from the LEDs, a reflector coupled to an inner side of a lower surface of the heat sink and reflecting light from an LED light source, a diffuser cover detachably coupled to the reflector and diffusing light from the LED light source, and a housing coupled to an outer side of the lower surface of the heat sink and protecting the reflector and the diffuser cover; an LED driver performing switching from alternating current (AC) supplied by a junction box to direct current (DC) and supplying an appropriate voltage to the LED module; a first connector unit connecting a first electric wire connected to the LED module of the downlight body and coming from a side of the heat sink with a second electric wire connected to a side of the LED driver; and a second connector unit integrated with the LED driver, and connecting the second electric wire connected to the LED driver with a third electric wire coming from the junction box. According to an embodiment of the present disclosure, the LED driver is separated from the downlight, so that the weight of the downlight is reduced. In addition, the first connector unit detachably connects the first electric wire connected to the LED module of the downlight with the second electric wire connected to the LED driver, thereby improving ease and convenience of installing the downlight.

Figure 2:
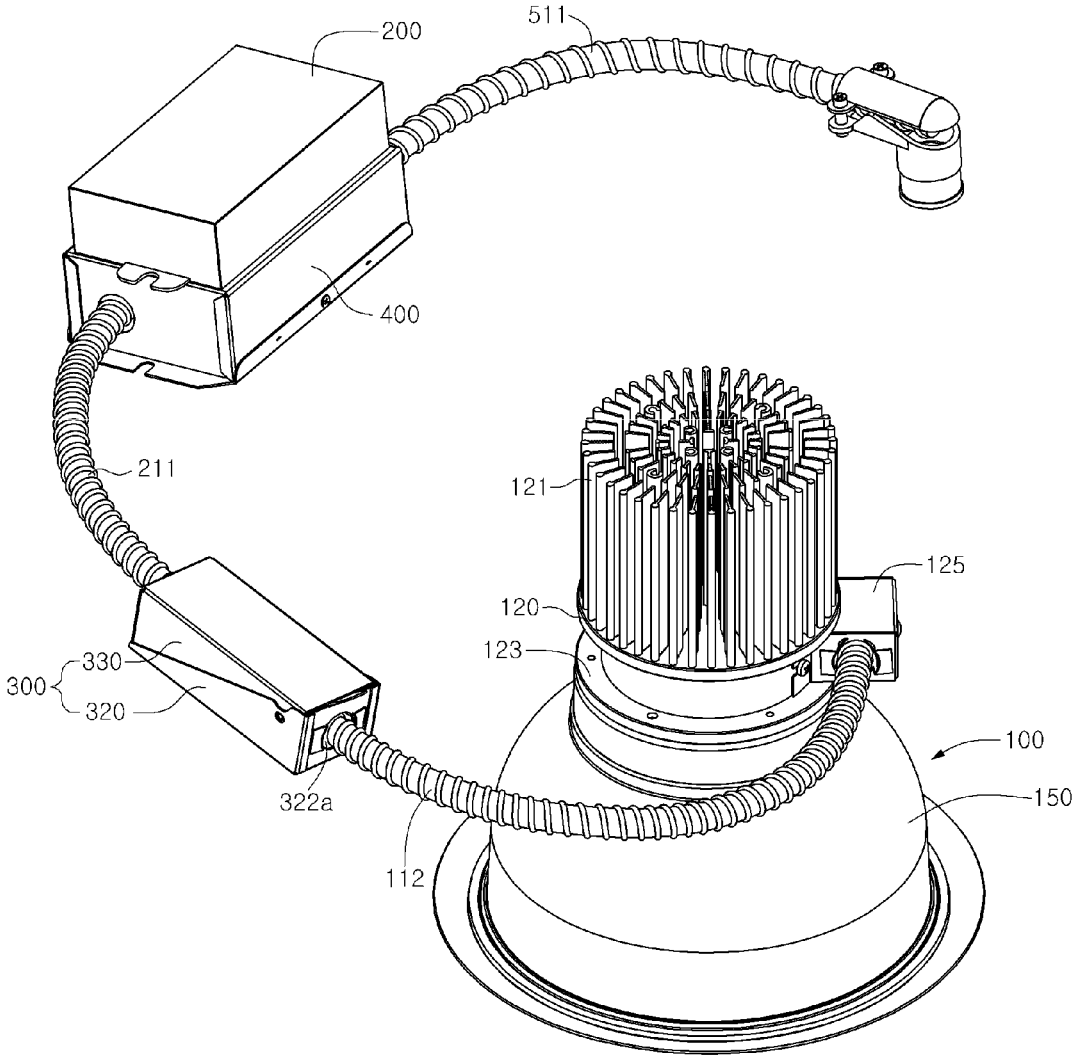
FIG. 2 is a perspective view showing an LED downlight device according to an embodiment of the present disclosure.
Figure 3:
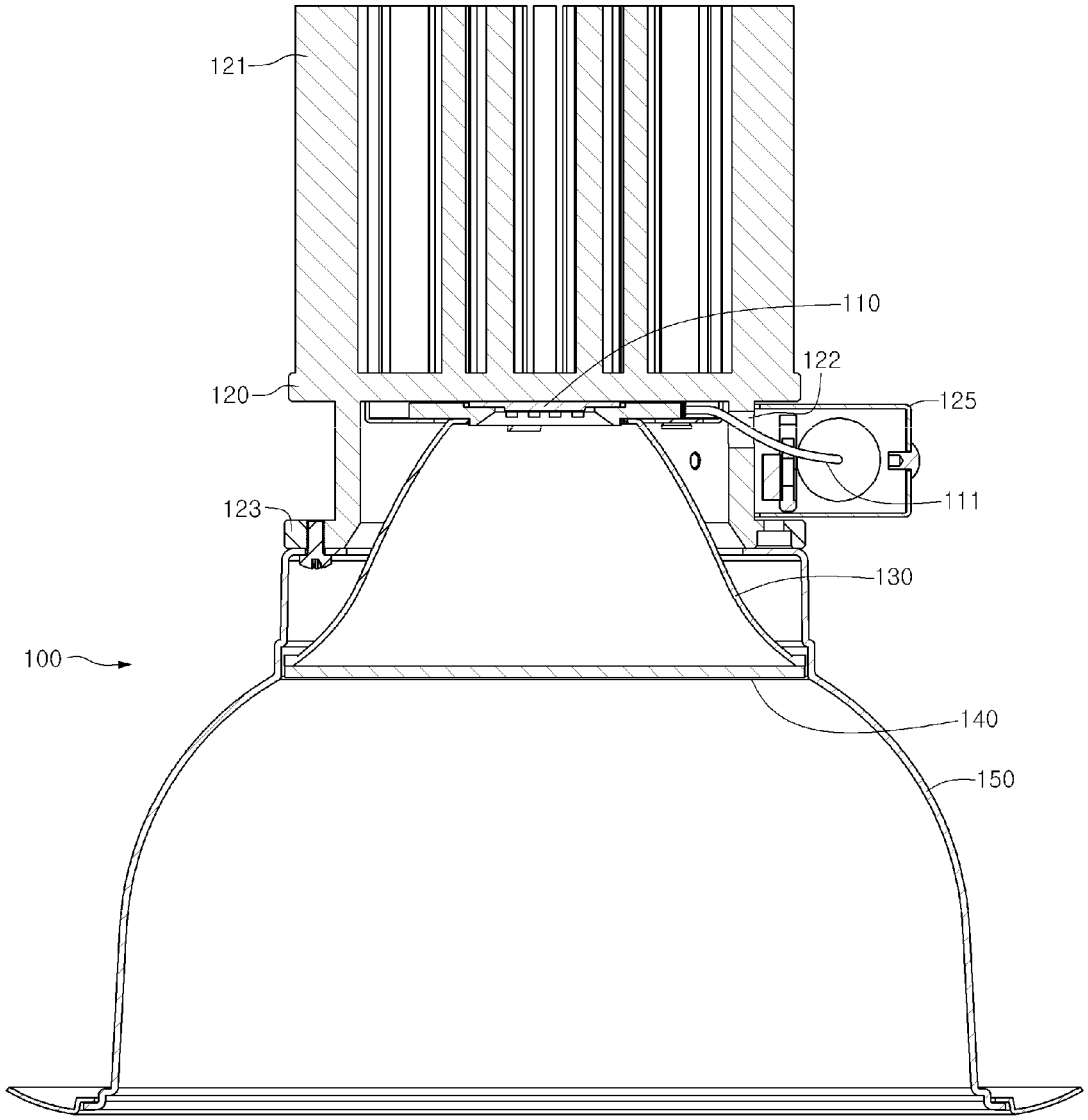
FIG. 3 is a cross-sectional view showing a downlight body of an LED downlight device according to an embodiment of the present disclosure.

As shown in FIGS. 2 and 3, according to an embodiment of the present disclosure, an LED downlight device includes a downlight body 100, an LED driver 200, a first connector unit 300, and a second connector unit 400.

First, the downlight body 100 includes: an LED module 110 having multiple LEDs provided at a circuit board; a heat sink 120 receiving the LED module 110 therein and supporting the same, and dissipating heat generated from the LEDs; a reflector 130 coupled to the inner side of a lower surface of the heat sink 120 and reflecting light from an LED light source; a diffuser cover 140 detachably coupled to the reflector 130 and diffusing light from the LED light source; and a housing 150 coupled to the outer side of the lower surface of the heat sink 120 and protecting the reflector 130 and the diffuser cover 140.

Herein, the heat sink 120 is manufactured through extrusion molding using a material, such as aluminum, having excellent thermal conductivity. The heat sink 120 is provided with multiple radiation fins 121 protruding in the vertical direction and being arranged radially. The lower surface of the heat sink 120 is provided with a space in which the LED module 110 is received.

In addition, at the lower portion of the heat sink 120, a hole 122 through which the outside is connected to the space in which the LED module 110 is formed. A flange portion 123 for connection with the housing 150 is formed below the hole 122.

The LED module 110 has one or more LEDs provided at the bottom of the circuit board. The LEDs are not limited in installation number and shape, and various emission colors may also be selected.

In addition, into the hole 122 of the heat sink 120, a metal casing 125 for connection of a first electric wire coming from the LED module 110 and for protection of a thermal protector is coupled.

In addition, the reflector 130 conical in shape reflecting light from the LED light source is coupled to the outer side of the LED module 110 coupled to the lower surface of the heat sink 120. The diffuser cover 140 protecting the LED module 110 and diffusing light emitted from the LED module 110 is coupled to the open lower part of the reflector 130.

In addition, the flange portion 123 of the heat sink 120 is coupled to the housing 150 protecting the reflector 130 and the diffuser cover 140.

On a side of the downlight body 100, the LED driver 200 for supplying power to the LED module 110 is provided.

The LED driver 200 is separated from the downlight body 100. A first side of the LED driver 200 is electrically connected to the LED module 110 and a second side of the LED driver 200 is electrically connected a junction box (not shown) supplying external electricity. That is, the LED driver 200 performs switching from alternating current (AC) of the external electricity supplied by the junction box (not shown) to direct current (DC) and then supplies an appropriate voltage to the LED module 110.

Herein, regarding electrical connection between the LED module 110 and the LED driver 200, the first connector unit 300 connects a first electric wire 111 with a second electric wire 210. The first electric wire 111 is connected to the LED module 110 and comes through the metal casing 125 of the heat sink 120, and the second electric wire 210 is connected to the first side of the LED driver 200.

Herein, the first and the second electric wire 111 and 210 are wrapped in spiral metal conduits 112 and 211 covering the outer sides of the electric wires for protection, respectively.

In addition, the first connector unit 300 includes a connector 310 connecting the first electric wire 111 with the second electric wire 210, and a connector cover covering the outer side of the connector 310 for protection. The connector cover includes a lower cover 320 and an upper cover 330 that are detachably coupled to each other.

Figure 4:
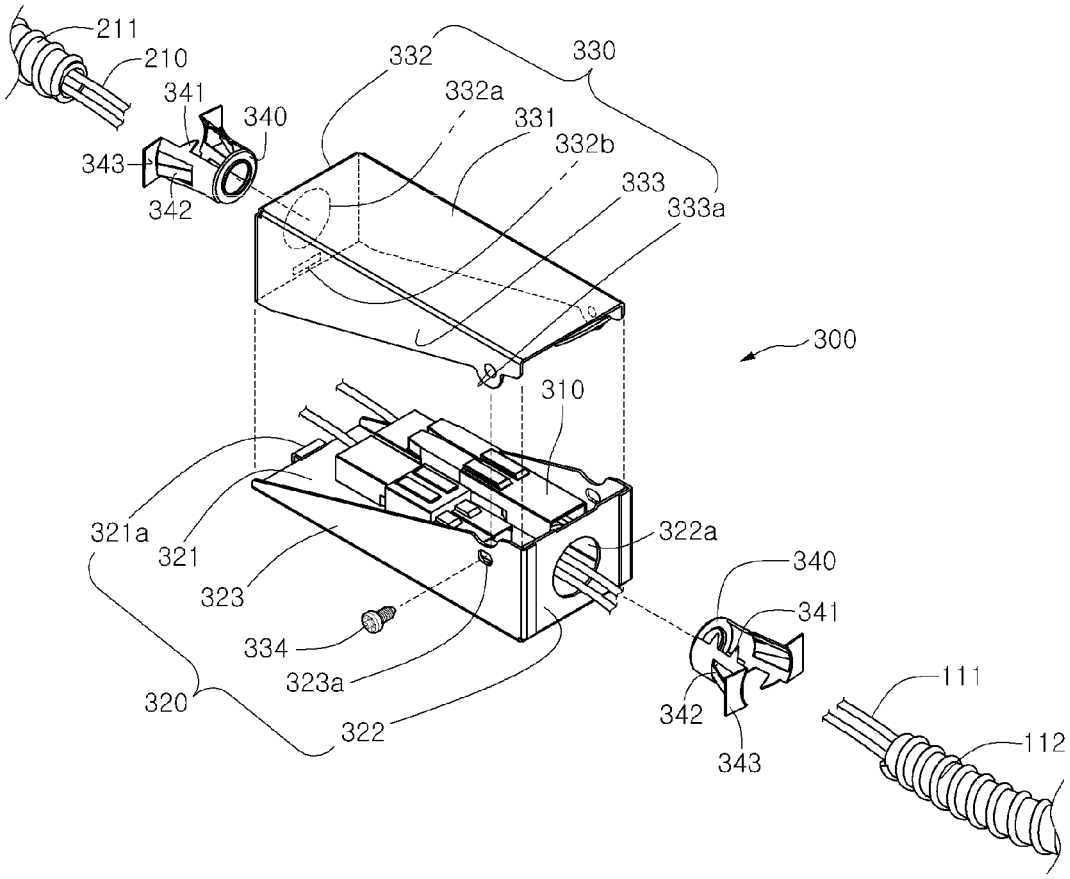
FIG. 4 is an exploded perspective view showing a structure of a first connector unit of an LED downlight device according to the embodiment of the present disclosure of FIG. 3.

As shown in FIG. 4, the lower cover 320 includes a bottom surface 321 having an end at which a front wall 322 stands vertically. In the front wall 322, a first electric wire insertion hole 322*a* into which the first electric wire 111 is inserted is formed. A hook 321*a* is formed at another end of the bottom surface 321 opposite to the front wall 322. In left and right side walls 323 connecting an upper end of the front wall 322 with the end of the bottom surface 321 at which the hook is formed, a first fastening hole 323*a* is formed at a position adjacent to the first electric wire insertion hole 322*a*.

In addition, the upper cover 330 includes a top surface 331 having an end at which a rear wall 332 stands vertically. In the rear wall 332, a second electric wire insertion hole 332*a* into which the second electric wire 210 is inserted is formed. A slot 332*b* into which the hook 321*a* of the lower cover 320 is engaged is formed below the second electric wire insertion hole 322*a*. In left and right side walls 333 connecting a lower end of the rear wall 332 with another end of the top surface 331, a second fastening hole 333*a* is formed at a position corresponding to the first fastening hole 323*a*.

In addition, the hook 321*a* of the lower cover 320 is engaged into the slot 332*b* of the upper cover 330 so that an end of the lower cover 320 and an end of the upper cover 330 are fixed. Then, another end of the lower cover 320 and another end of the upper cover 330 are pressed against each other so that the first fastening hole 323*a* of the lower cover 320 and the second fastening hole 333*a* of the upper cover 330 are aligned. Next, a fastening bolt 334 is fastened into the first fastening hole 323*a* and the second fastening hole 333*a*.

Herein, into the first and the second electric wire insertion hole 322*a* and 332*a*, clips 340 fixing the spiral metal conduits 112 and 211 are coupled, respectively. Each clip 340 is partially cut in the longitudinal direction of its hollow body into which the spiral metal conduit 112, 211 is inserted. At the cut surface, a protruding piece 341 engaged in the spiral groove of the spiral metal conduit 112, 211 is formed. At the outer side of the body, a wing piece 342 caught inside the electric wire insertion hole 322*a*, 332*a* and a flange 343 caught outside the electric wire insertion hole 322*a*, 332*a* are provided.

The clip 340 has tension through the cut in the longitudinal direction. The wing piece 342 and the flange 343 of the clip 34 are supported on the inner surface and the outer surface of the electric wire insertion hole 322*a*, 332*a*, respectively, to fix the clip 340 so as not to be separated. The protruding piece 341 formed at the clip 340 is engaged in the spiral groove of the metal conduit 112, 211, thereby fixing the metal conduit 112, 211.

In addition, the first electric wire 111 and the second electric wire 210 coming from the insides of the metal conduits 112 and 211 are connected to the opposite sides of the connector 310, respectively.

As described above, by making the first connector unit 300 connect the first electric wire 111 connected to the LED module 110 with the second electric wire 210 connected to the LED driver 200, the LED driver 200 and the downlight body 100 are easily separated from each other if necessary.

In addition, regarding electrical connection between the LED driver 200 and the junction box (not shown), the second connector unit 400 connects the second electric wire 210 connected to the first side of the LED driver 200 with a third electric wire 510 coming from the junction box. Herein, a side of the second electric wire 210 is connected to the first connector unit 300 connected to the first electric wire 111, and another side of the second electric wire 210 is connected to the second connector unit 400 connected to the third electric wire 510.

Figure 5:
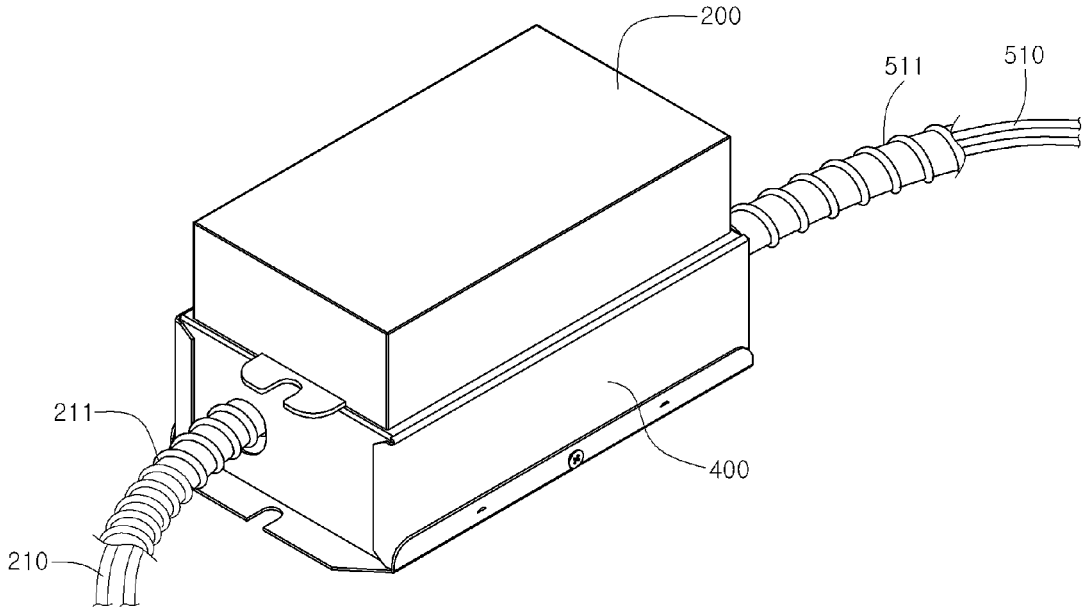
FIG. 5 is a perspective view showing an LED driver and a second connector unit are integrated in an LED downlight device according to the embodiment of the present disclosure of FIG. 3.

As shown in FIG. 5, the second connector unit 400 is integrated with the LED driver 200. That is, alternating current (AC) of external electricity supplied through the third electric wire 510 connected to a first side of the second connector unit 400 is supplied to the LED driver 200 and switching to direct current (DC) takes place. The direct current (DC) is output to the second electric wire 210 connected to a second side of the second connector unit 400.

Next, the direct current (DC) output through the second electric wire 210 is supplied to the first electric wire 111 connected to the first connector unit 300 and is thus applied to the LED module 110.

Herein, the second connector unit 400 includes a connector connecting the second electric wire 21 with the third electric wire 510, and a connector cover covering the outer side of the connector for protection.

In addition, the third electric wire 510 is wrapped in a spiral metal conduit 511 covering the outer side of the electric wire for protection.

In addition, the size of the LED driver 200 may vary depending on the value of the watt (W). Depending on the size, the LED driver 200 may be provided inside the connector cover or may be provided outside the connector cover, being integrated with the connector cover.

In addition, either the LED driver 200 or the second connector unit 400 may be fixed to a fixing bracket (not shown) pre-installed inside the ceiling. Provided at the outer surface of either the LED driver 200 or the second connector unit 400, a frame (not shown) for fixing may be integrated with the same.

In the LED downlight device configured as described above, first, the second connector unit 400 integrated with the LED driver 200 may be fixed to the fixing bracket inside the ceiling, or the integrated frame at the outer surface of the LED driver 200 or the second connector unit 400 may be fixed in the ceiling. Next, the third electric wire 510 connected to the first side of the second connector unit 400 is connected to the junction box (not shown). The second electric wire 210 connected to the second side of the second connector unit 400 is connected to a side of the first connector unit 300.

In addition, the first electric wire 111 connected to the LED module 110 of the downlight and coming from a side of the heat sink 120 is connected to another side of the first connector unit 300.

Then, the downlight body 100 is inserted into the hole formed in the ceiling to be recessed.

Herein, the alternating current (AC) input through the third electric wire 510 is supplied to the LED driver 200 and switching to the direct current (DC) takes place. The direct current (DC) is output to the second electric wire 210 and is supplied to the LED module 110 through the first electric wire 111 connected to the first connector unit 300.

As described above, according to the present disclosure, the LED driver is separated from the downlight, so that the weight of the downlight is reduced. In addition, the first connector unit detachably connects the first electric wire of the LED module of the downlight with the second electric wire connected to the LED driver, thereby improving ease of installing the downlight.

In addition, when the downlight or the LED driver fails or runs out, individual replacement can be achieved, and only the LED driver needs to be replaced depending on the required power, so that maintenance cost can be reduced and flexibility in management can be ensured.

In addition, the second connector unit and the LED driver are integrated, so that convenience of installing and replacing the LED driver can be improved.

Although the exemplary embodiments of the present disclosure have been described, the present disclosure is not limited to the particular embodiments described above. That is, those skilled in the art to which the present disclosure pertains are able to make various changes and modifications without departing from the idea and the scope of the appended claims. Such appropriate changes and modifications should be regarded as equivalents and belonging to the scope of the present disclosure.

What is claimed is:

1. An LED downlight device comprising:

a downlight body including an LED module having multiple LEDs provided at a circuit board, a heat sink receiving the LED module therein and supporting the same and dissipating heat generated from the LEDs, a reflector coupled to an inner side of a lower surface of the heat sink and reflecting light from the LEDs, a diffuser cover detachably coupled to the reflector and diffusing light from the LEDs, and a housing coupled to an outer side of the lower surface of the heat sink and protecting the reflector and the diffuser cover;

an LED driver performing switching from alternating current (AC) supplied by a junction box to direct current (DC) and supplying an appropriate voltage to the LED module;

a first connector unit connecting a first electric wire connected to the LED module of the downlight body and coming from a side of the heat sink with a second electric wire connected to a side of the LED driver; and a second connector unit integrated with the LED driver, and connecting the second electric wire connected to the LED driver with a third electric wire coming from the junction box.

2. The LED downlight device of claim 1, wherein each of the first, the second, and the third electric wire is wrapped in a spiral metal conduit covering an outer side of each of the electric wires for protection.

3. The LED downlight device of claim 2, wherein the first connector unit comprises a connector connecting the first electric wire with the second electric wire, and a connector cover covering an outer side of the connector for protection, and the connector cover comprises an upper cover and a lower cover that are detachably coupled to each other.

4. The LED downlight device of claim 3, wherein the lower cover comprises a bottom surface having an end at which a front wall stands vertically, a first electric wire insertion hole into which the first electric wire is inserted is formed in the front wall, a hook is formed at another end of the bottom surface opposite to the front wall, and a first fastening hole is formed at a position adjacent to the first electric wire insertion hole, in left and right side walls connecting an upper end of the front wall with the end of the bottom surface at which the hook is formed;

the upper cover comprises a top surface having an end at which a rear wall stands vertically, a second electric wire insertion hole into which the second electric wire is inserted is formed in the rear wall, a slot into which the hook of the lower cover is engaged is formed below the second electric wire insertion hole, and a second fastening hole is formed at a position corresponding to the first fastening hole, in left and right side walls connecting a lower end of the rear wall with another end of the top surface; and the hook of the lower cover is engaged into the slot of the upper cover so that an end of the lower cover and an end of the upper cover are fixed, and another end of the upper cover and another end of the lower cover are pressed against each other so that the first fastening hole of the lower cover and the second fastening hole of the upper cover are aligned, and a fastening bolt is fastened into the first fastening hole and the second fastening hole.

5. The LED downlight device of claim 4, wherein a clip fixing the spiral metal conduit is coupled into each of the first and the second electric wire insertion hole, the clip is partially cut in a longitudinal direction of its hollow body into which the spiral metal conduit is inserted, a protruding piece engaged in a spiral groove of the metal conduit is formed at the cut surface, and a wing piece caught inside the electric wire insertion hole and a flange caught outside the electric wire insertion hole are provided at an outer side of the body.

6. The LED downlight device of claim 1, wherein the second connector unit comprises a connector connecting the second electric wire with the third electric wire, and a connector cover covering an outer side of the connector for protection, and a size of the LED driver varies depending on a value of a watt (W), and depending on the size, the LED driver is provided inside the connector cover or provided outside the connector cover, being integrated with the connector cover.

7. The LED downlight device of claim 1, further comprising:

a frame for fixing that is provided outside the LED driver or the second connector unit.

* * * * *